United States Patent [19]

Mathews

[11] 4,347,979

[45] Sep. 7, 1982

[54] SWIMMING POOL CLEANER

[76] Inventor: Lester R. Mathews, 9810 N. 37th St., Phoenix, Ariz. 85028

[21] Appl. No.: 118,317

[22] Filed: Feb. 4, 1980

Related U.S. Application Data

[63] Continuation-in-part of Ser. No. 843,870, Oct. 20, 1977, Pat. No. 4,202,499.

[51] Int. Cl.[3] ..... B05B 3/06

[52] U.S. Cl. ..... 239/206; 4/490; 134/167 R; 239/240; 239/600

[58] Field of Search ..... 239/201–206, 239/132.5, 240, 600; 134/167 R, 168 R, 176, 179; 15/1.7; 4/490

[56] References Cited

U.S. PATENT DOCUMENTS

| | | | |
|---|---|---|---|
| 575,966 | 1/1897 | Main | 239/240 |
| 2,048,125 | 7/1936 | Irving et al. | 239/201 |
| 2,709,623 | 5/1955 | Glynn | 239/201 |
| 3,107,056 | 10/1963 | Hunter | 239/206 |
| 3,301,489 | 1/1967 | Tropeano et al. | 239/201 |
| 3,645,451 | 2/1972 | Hauser | 239/206 |
| 3,675,252 | 7/1972 | Ghiz | 4/492 |
| 3,724,757 | 4/1973 | Hunter | 239/205 |
| 4,185,781 | 1/1980 | O'Brien | 239/600 |
| 4,188,673 | 2/1980 | Carter | 4/490 |
| 4,202,499 | 5/1980 | Mathews | 239/206 |

*Primary Examiner*—Robert B. Reeves
*Assistant Examiner*—Michael J. Forman
*Attorney, Agent, or Firm*—Don J. Flickinger

[57] ABSTRACT

A pop-up cleaner for a swimming pool. The gear housing of the cleaner is removably positioned in a fitting in a circular opening in the floor of the pool. A jet block is mounted on a linear movable hollow tube that rotates with a rotor mounted in the gear housing, which rotor is connected through a reduction gear train mounted in the gear housing to an impeller mounted in a turbine casing on the gear housing. The fitting is adapted to be connected by a conduit to a water pump. When water under pressure is present in the conduit, the jet block projects out the fitting and a stream of water under pressure is directed substantially parallel to the surface of the pool in the vicinity of the cleaner. Water flowing through the cleaner rotates an impeller which through the reduction gear rotates the jet block at a substantially constant angular velocity. When the pump is turned off, the jet block returns into the fitting.

5 Claims, 13 Drawing Figures

SWIMMING POOL CLEANER

CROSS-REFERENCE TO RELATED APPLICATION

This application is a continuation-in-part of application Ser. No. 843,870 filed Oct. 20, 1977 now U.S. Pat. No. 4,202,499, issued May 13, 1980.

BACKGROUND OF THE INVENTION

The present invention relates to swimming pool cleaners and is concerned primarily with a cleaner which is mounted in a fitting in an opening in the pool floor and which is provided with a mechanism for lifting a jet block above the pool floor to expose an outlet opening therein, rotating the block, and at the same time ejecting water from the opening under pressure as a jet, all of which operations are performed by water under pressure coming from a suitable source of supply.

At the present time, the installation of home swimming pools is becoming more and more widespread. A significant amount of time and effort is required to clean such pools. Great difficulty has been experienced in attempting to provide automatic means for cleaning the bottom walls of such pools. In recent years, the use of plastic swimming pools has become more and more widespread. Plastic swimming pools also have experienced problems in cleaning the walls thereof. The present invention is concerned primarily with the provision of a swimming pool cleaner which may be mounted in a fitting secured in an opening formed in the pool and which provides a mechanism for raising a jet block from a position in which it is substantially flush with the floor; i.e., it is substantially positioned within its fitting, to one in which it delivers a jet of water substantially parallel to the adjacent surfaces of the pool and rotates the block with the power to do so derived from the pressure of water from an appropriate source of supply.

There are examples in the prior art of pop-up sprinklers for grass lawns in which a nozzle is rotated, or oscillated, between fixed limits by water under pressure from a suitable source and of using such lawn sprinklers to clean swimming pools. Attempts to use lawn sprinklers as pool cleaners has not worked out satisfactorily. The reasons are because many lawn sprinklers are provided with complex mechanisms to oscillate the sprinkler head over various arcs, or to produce multiple patterns of areas to be watered which is neither appropriate nor necessary in a pool cleaner. The means for mounting sprinkler heads in the ground where they are readily available for adjustment, service, or repair are not appropriate for a pool cleaner mounted in a wall or a floor of a swimming pool several feet below the surface of the pool. The ease of mounting of the pool cleaner so that it can be easily installed, and removed for service, repaired, or replacement is an important attribute of a swimming pool cleaner.

OBJECTS OF THE INVENTION

With the foregoing conditions in mind, the present invention has in view the following objectives:

1. To provide a swimming pool cleaner that is particularly adapted for use in swimming pools, whether plastic or concrete, having a bottom floor with an opening therein with the cleaner being mounted in a fitting in the bottom floor within said opening.

2. To provide a swimming pool cleaner of the type noted which is powered by a source of water under pressure.

3. To provide a swimming pool cleaner which includes a cylindrical jet block having a cylindrical surface and formed with a passageway therethrough which intersects said cylindrical surface to form an opening in said surface, together with a mechanism which is energized by said water pressure to raise the block above the level of said pool floor to expose the opening in said cylindrical surface.

4. To provide a swimming pool cleaner of the kind described which includes means for rotating said jet block through a fully 360 degrees under the pressure of said water supply.

5. To provide a swimming pool cleaner of the character aforesaid in which said means for rotating the jet block comprises a turbine having an impeller which is operatively connected to one end of a reduction gear train and the other end of which is drivably connected to a ring gear on a rotor.

6. To provide a swimming pool cleaner of the kind described in which substantially all of the parts are of plastic and with means to lubricate the reduction gear train.

7. To provide a swimming pool cleaner of the kind described in which means are incorporated to facilitate installation and removal of the cleaner from its fitting which fitting is positioned in a swimming pool.

Various other more detailed objects and advantages of the invention such as arise in connecting with carrying out the above-noted ideas in practical embodiments will in part become apparent and in part be hereinafter stated as the description of the invention proceeds.

SUMMARY OF THE INVENTION

The foregoing objects are achieved by providing a cleaner for a swimming pool, plastic or concrete, having a circular opening in its floor, or walls, which cleaner is mounted in a fitting in the opening and which fitting is adapted to be connected to a conduit which conduit is connected to a source of water under pressure.

The gear housing of the cleaner is provided with a cylindrical disk which constitutes its upper end. The gear housing and the fitting are provided with cooperating mechanical means to removably position, or mount the gear housing in the fitting. A cylindrical wall depends from the disk and a bottom wall. An upper wall is positioned between the disk and the hollow wall with the space between the disk and the upper wall forming a ring gear chamber. One or more openings are formed through the bottom wall to permit water to flow into the gear housing. A rotor is journaled through the disk for rotation about an axis of rotation. An internally toothed ring gear is made integral with the rotor and is positioned in the ring gear chamber. A hollow tube is positioned in the rotor for limited linear movement with respect to the rotor from a retracted position to a projected position and for rotation with the rotor. The jet block of the cleaner is removably secured to the upper end of the hollow tube. A passage is formed through the jet block which communicates with the hollow tube so that water can flow from the interior of the gear housing through the hollow tube and the passage through the jet block. The jet of water from the jet block lies substantially in a plane perpendicular to the axis of rotation of the rotor. A turbine casing is secured to the bottom wall of the gear housing. The turbine casing is provided with water inlets so that water can flow through the inlets into the turbine casing. An impeller is mounted for rotation within said casing and a first shaft journeled through the bottom wall of the gear housing. A reduction gear train is mounted in the gear housing between the first shaft and a second shaft journaled for rotation through the upper wall of the gear housing. Gear means are mounted on the second shaft to engage the teeth of the ring gear to rotate the ring gear, the rotor, the hollow tube and the jet block. The disk of the gear housing is removably positioned in the fitting. Water under pressure applied to the gear housing will cause the impeller to rotate, the tube to move to its extracted position of the jet block to rotate so that a stream of water is directed over the surface of the pool adjacent the opening in which the cleaner is positioned. When water under pressure is not applied, the hollow tube returns to its retracted position with the jet block positioned substantially in the fitting.

BRIEF DESCRIPTION OF THE DRAWINGS

For a full and more complete understanding of the invention, reference may be had to the following description and accompanying drawings, wherein.

DESCRIPTION OF THE PREFERRED EMBODIMENTS

Figure 1:
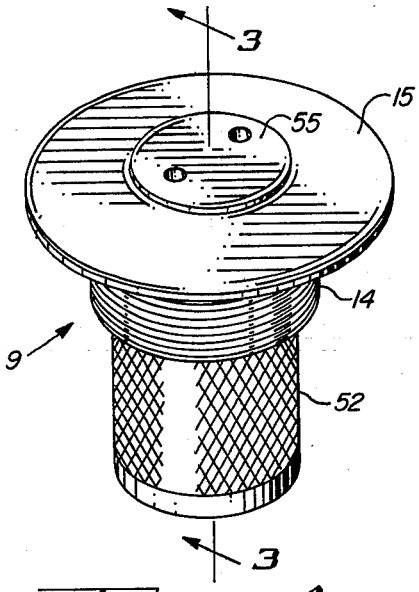
FIG. 1 is a perspective of one embodiment of a swimming pool cleaner designed in accordance with the precepts of this invention.
Figure 2:
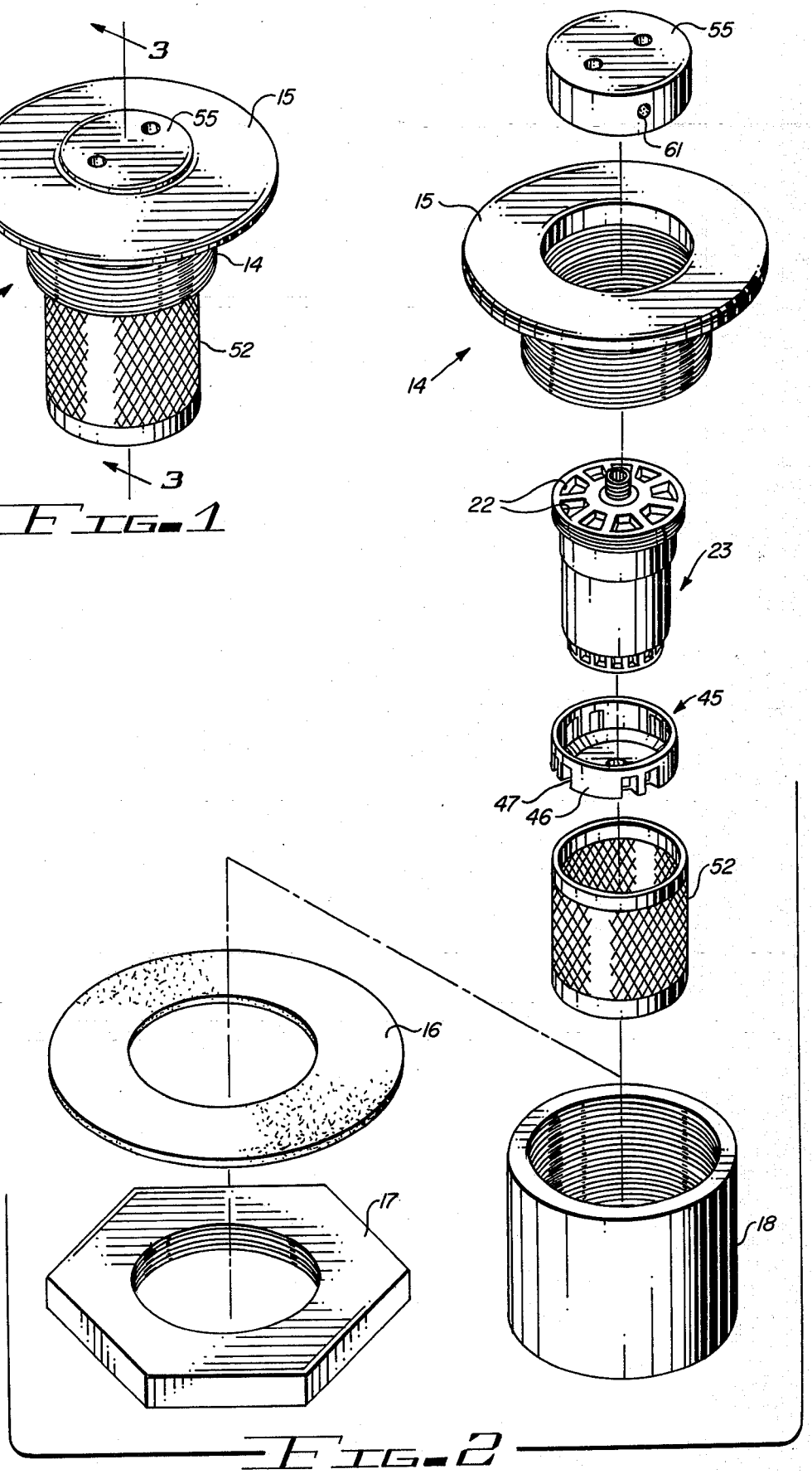
FIG. 2 is a perspective illustrating the elements of the cleaner of FIG. 1 in exploded relation.
Figure 3:
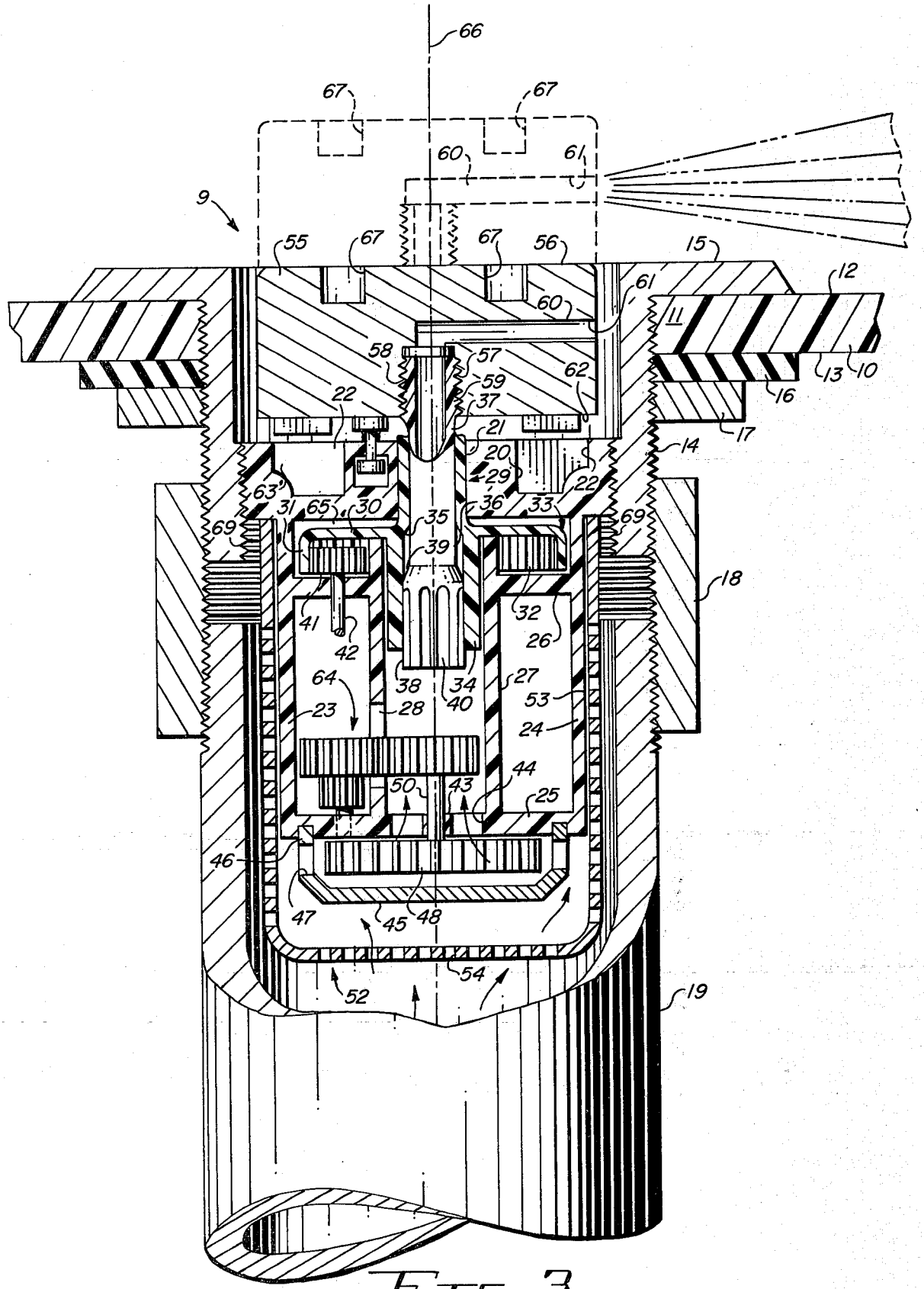
FIG. 3 is a vertical section on an enlarged scale through a portion of the floor of a swimming pool formed with an opening therein and with the pool cleaner of FIGS. 1 and 2 mounted within said opening and clamped to the pool floor.
Figure 6:
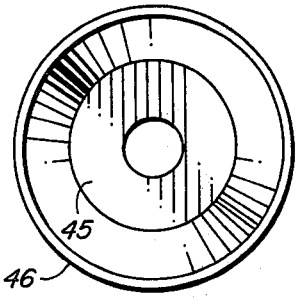
FIG. 6 is a bottom view of the turbine casing of FIG. 5.
Figure 9:
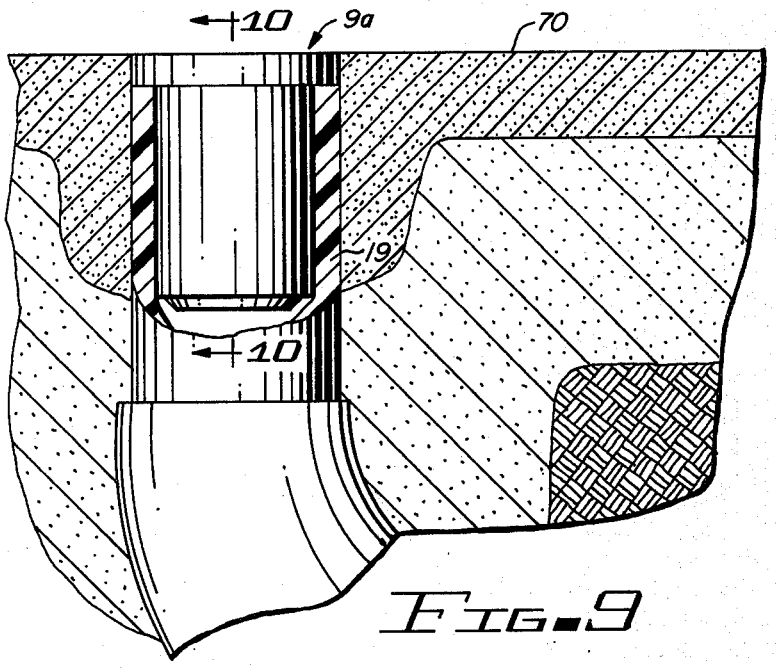
FIG. 9 is a side elevation partly broken away through the bottom wall of a cement swimming pool showing a second embodiment of the swimming pool cleaner installed therein.

Referring first and more particularly to FIG. 3, the swimming pool cleaner 9 of the invention is illustrated as being mounted in the floor of a plastic swimming pool 10. Pool 10 is formed with a threaded circular opening 11, and has an upper surface 12 and a bottom surface 13. A nipple, or fitting, 14 has an annular flange 15 at its upper end which engages surface 12 as nipple 14 is screwed into opening 11. A gasket 16 is positioned about nipple 14 and pressed against pool surface 13 by nut 17 which is threaded onto nipple 14.

Also threaded onto the nipple 14 is coupling 18, the lower end of which is connected to conduit 19 which extends to a source of water under pressure, a water pump, for example. The bore of nipple 14 is also partially threaded, and thick disk 20 which is provided with threads is threaded into fitting 14. Thick disk 20 also constitutes the top wall of gear housing 23. Disk 20 is formed with a central aperture 21 which functions as a bearing as will be later described and has a plurality of recesses 22 opening onto its upper face. Gear housing 23 comprises an outer cylindrical wall 24 which depends from disk 20 and a bottom wall 25. Disk 20, and walls 24 and 25 are preferrably made as an integral unit. A ring-like partition, or upper wall, 26 has its peripheral edge integrally joined to cylindrical wall 24 with its inner edge defining an aperture which receives duct 27. The upper end of duct 27 is spaced from disk 20 and it lower edge is integrally joined to bottom wall 25. The space between disk 20 and upper wall 26 defines ring gear chamber 65. Duct 27 has an orifice 28 therein for a purpose to be described later.

Rotor 29 comprises an annular member 30 from which depends a shirt 31 formed with internal gear teeth 32. Member 30, skirt 31 and gear teeth 32 collectively constitute ring gear 33. Rotor 29 is formed with an upwardly extending tubular extension which is rotatably received in aperture 21 and a lower tubular extension 34 of larger diameter than the upwardly extending tubular extension of rotor 29, thus providing an annular shoulder 35 between these two tubular extensions. Tube 36 has an upper portion 37 that is snugly received in the upwardly extending tubular extension of rotor 29 and a lower portion 38 that is received in lower extension 34. An annular shoulder 39 is located between these upper and lower portions and constitutes an abutment which cooperates with shoulder 35.

Lower extension 34 is internally splined (not illustrated) and the lower end portion of tubular part 38 is formed with external splines 40 which mesh with the internal splines of lower extension 34. Thus, while tube 36 rotates with rotor 29, relative axial movement is permitted between these members between a retracted position and a projected position, but such axial movement is limited in the upper direction by shoulders 35 and 39.

As shown in FIG. 3, gear 41 which is located in ring gear chamber, 65 meshes with the internal gear teeth 32 of ring gear 33 of rotor 29. Gear 41 is mounted on the upper end of a shaft 42 which is journaled for rotation in upper wall 26. Shaft 42 constitutes one end of a conventional reduction gear train 64.

Figure 7:
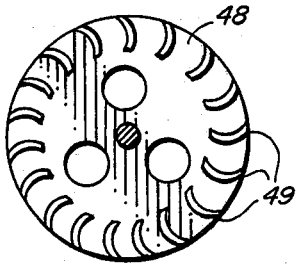
FIG. 7 is a plan view of an impeller.
Figure 4:
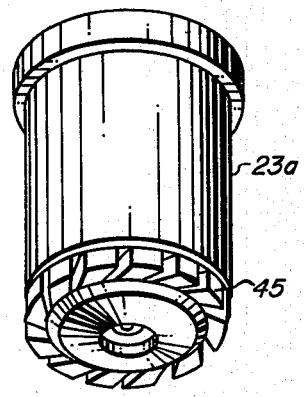
FIG. 4 is a perspective of the gear housing.

Bottom wall 25 of gear housing 23 is formed with a central bearing opening 43 and water inlets 44. A turbine casing 45 depends from and is connected to bottom wall 25 and has a cylindrical wall 46 formed with tangential water inlets 47. An impeller 48 (see FIG. 7) includes blades 49 and is drivably mounted on the lower end of shaft 50 which is journaled in bearing opening 43. Gear 51 is drivably mounted on the upper end of shaft 50 and constitutes the other end of the reduction gear train 64.

A screen 52 includes a cylindrical wall 53, the upper end of which is anchored to disk 20 of gear housing 23 but in spaced relation to the cylindrical wall 24 thereof and also in spaced relation to the bores of nipple 14 and conduit 19. Screen 52 also includes a bottom wall 54 that is spaced from turbine casing 45. A cylindrical jet block 55 is positioned within the upper end of the bore of nipple 14 and, when the cleaner is not in use, jet block 55 is retracted into fitting 14 so that its upper face, or surface, 56 is substantially flush with the upper face of flange 15. Jet block 55 is formed with a threaded socket 57 into which is screwed the upper end portion 58 of tube 36. Tube 36 has a bore 59 which is in communication with horizontal arm 60 which, together with socket 57, constitutes a passage through jet block 55 which in the embodiment of FIG. 3 is L-shaped. The open end of passage arm 60, or opening, is shown at 61. Jet block 55 has a lower face, or surface, 62 which is normally spaced above disk 20 of the gear housing and is maintained in this position by a spring-biased pin 63 positioned in a recess of disk 20. Spring-biased pin 63 prevents jamming of the parts when water pressure is discontinued and jet block 55 and tube 36 fall down, or retract, into fitting 14 under the action of gravity, for example.

A conventional reduction gear train 64 is connected between shaft 50 on which is mounted gear 51 and shaft 42 to which is connected gear 41 which meshes with teeth 32 of ring gear 33 so that when impeller 48 is rotated, ring gear 33 and rotor 29 will also rotate, but at a significantly lower angular velocity about rotor 29's axis of rotation 66 which is also the axis of symmetry of jet block 55. Since gear train 64 is conventional, details of the gear train are not illustrated.

In order to install swimming pool cleaner 9 in fitting 14, or to remove cleaner 9 from fitting 14 after being installed, the upper surface 56 of jet block 55 is provided with two or more recesses 67 into which an appropriate tool can be inserted to grip or hold jet block 55 and to rotate it or apply torque to it. To transmit torque applied to jet block 55 to disk 20 to either thread disk 20 into the threads of fitting 14 or to unthread it, the lower face 62 of jet block 55 is provided with one or more projections 68 that fit into recesses 22 in disk 20 when downwardly directed pressure is applied to jet block 55 sufficient to compress the spring of spring bias pin 63 sufficiently so that projections 68 will extend into recesses 22 of gear housing 23. The bore of fitting 14 is provided with a shoulder 69 to limit the distance into fitting 14 that disk 20 can be threaded to that distance where the upper surface 56 of jet block 55 will be substantially coplanar with the top surface of annular flange 15 of fitting 14 when jet block 55 is in its normal retracted position as illustrated in solid lines in FIG. 3.

Figure 10:
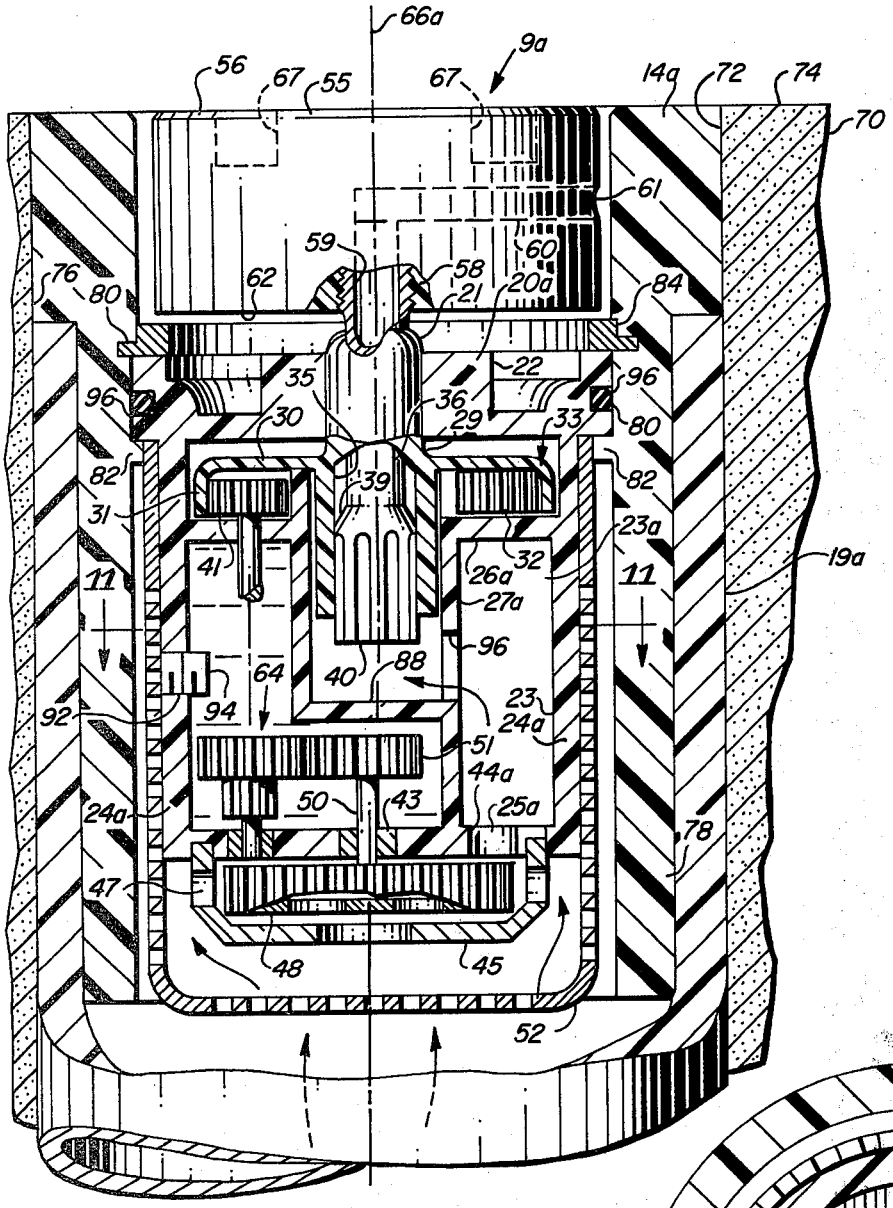
FIG. 10 is an enlarged section taken on line 10—10 of FIG. 9.
Figure 11:
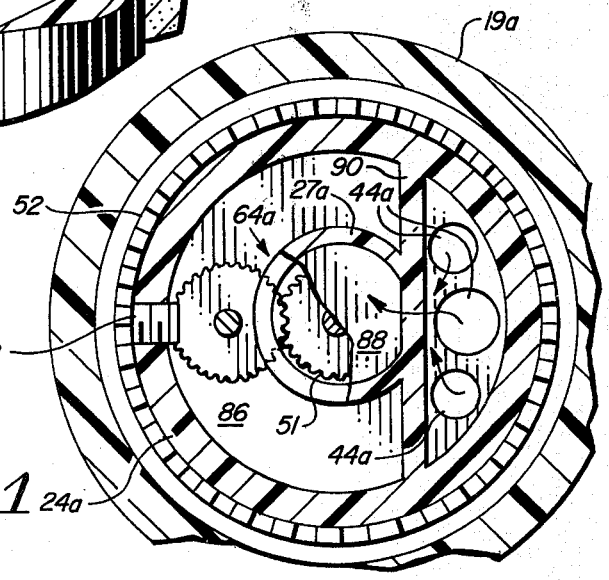
FIG. 11 is a section taken on line 11—11 of FIG. 10.

In FIG. 10 a second embodiment of the invention, swimming pool cleaner **9*a*, is disclosed which embodiment is adapted to be mounted in cement swimming pool 70. In describing the embodiment of FIG. 10, elements of the invention that differ in some degree from corresponding elements of the embodiment of FIG. 3 will be identified by the suffix "a". When pool 70 is formed, conduit 19*a* will be positioned in opening 72 in pool 70 so that conduit 19*a* ends or terminates a distance below the surface 74 of pool 70 which distance substantially equals the length of shoulder 76 of fitting 14*a*. The lower portion 78 of fitting 14*a* has an external diameter such that fitting 14*a* can be inserted into conduit 19*a*. Typically conduit 19*a* and fitting 14*a* are made of plastic materials that can be essentially permanently glued together to produce a water tight connection. Fitting 14*a* is provided with a circular groove 80 and a circular shoulder 82. Disk 20*a* of gear housing 23*a* is positioned in fitting 14*a* by engaging shoulder 82 to limit the extent that gear housing 23*a* can be inserted into fitting 14*a*. Split snap ring 84 is inserted into groove 80 to prevent gear housing 23*a* from moving upwardly once preperly positioned in fitting 14*a*. Another significant difference between the embodiment of FIG. 10 and that of FIG. 3, is that in gear housing 23*a* reduction gear train 64 is located in a substantially sealed gear chamber 86 which is preferrably filled with an appropriate lubricant, such as a lubricating oil. To form chamber 86, duct 27*a* has its lower end closed or sealed off by wall 88 and there are no openings in bottom wall 25*a* that would communicate with chamber 86. As seen in FIG. 10, the walls defining chamber 86 includes parts of outer cylindrical wall 24*a*, bottom wall 25*a*, upper wall 26*a*, duct 27*a* and wall 88. In FIG. 11, it can be seen that wall 90 which is substantially tangent to duct 27*a*, completes the enclosure of chamber 86. An opening 92 is formed through the part of outer wall 24*a* defining chamber 86, which opening 92 is closed by threaded plug 94 so that a lubricant such as oil can be added to chamber 86 when servicing cleaner 9*a*. Jet block 55 of cleaner 9*a* is provided with a pair of recesses 67 which facilitate the threading of jet block 55 onto and off of the upper end portion 58 of tube 36 to provide access to gear housing 23*a* and split ring 84**.

When block 55 is removed, snap ring 84 can be removed from groove 80 so that disk **20*a* and gear housing 23*a* can be removed from fitting 14*a*. Recesses 22 and disk 20*a* make it possible to grip cleaner 9*a* in a tool for removal or insertion. To provide an essentially water tight seal between disk 20*a* and fitting 14*a*, the exterior cylindrical surface of disk 20*a* is provided with a conventional "O" ring recess 96 in which is located a conventional "O" ring 98**.

Figure 12:
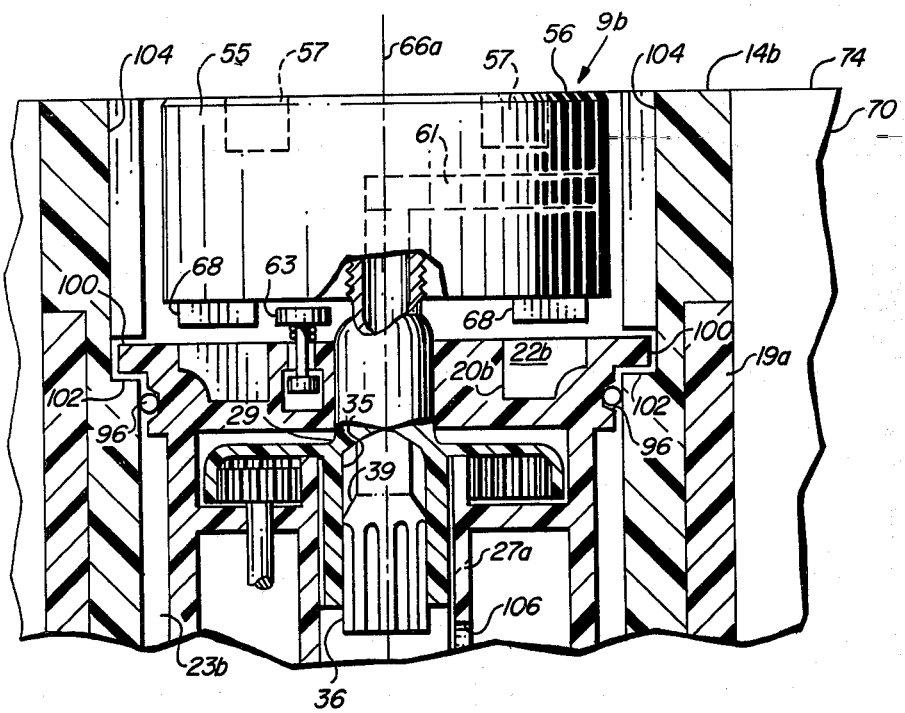
FIG. 12 is a section similar to that of FIG. 10 illustrating another way of removably securing the gear housing of a pool cleaner to a fitting positioned in a pool.

In FIG. 12 a third embodiment of the invention is illustrated. The portions of swimming pool cleaner **9*b* not illustrated or, in the preferred embodiment, substantially the same as the embodiment illustrated in FIG. 10. Thick disk 20*b* is provided with two or more projections 100 which cooperate with substantially horizontal groove 102 in fitting 14*b* to removably disk mount 20*b* and gear housing 23*b* within fitting 14*b*. Projections or lugs 100 move through vertical grooves 104 in fitting 14*b* until they reach the level of grooves 102. Jet block 55 is provided with projections 68 which fit into recesses 22*b* to rotate disk 20*b* when sufficient force is applied to jet block 55 to compress spring biased pin 63 sufficiently for projections 68 to engage the wall means defining recesses 22*b*. Disk 22*b* is provided with a conventional "O" ring recess 96 in which is positioned an "O" ring to substantially prevent water from flowing between disk 22*b* and the inner bore of fitting 14*b***.

Jet block 55 is provided with two or more recesses 57 in its top surface 56 into which an appropriate tool can be inserted to hold cleaner **9*b* while mounting it in fitting 14*b*, and similarly to grip or hold swimming pool cleaner 9*b* while cleaner 9*b* is being removed for servicing, or replacement. The means for positioning or mounting cleaner 9*b*, for example, in fitting 14*b* includes recesses 57, projections 100 on disk 20*b*, projections 68 on jet block 55 which cooperate with recesses 22*b* of disk 20*b* to transmit torque applied to jet block 55 to gear housing 23 as well as cooperating recesses 102, 104 in fitting 14*b*. With an appropriate tool, cleaner 9*b***, as well as the other modifications of the invention, can be inserted or removed by a person positioned above the surface of the water in a swimming pool.

THE OPERATION

While the mode of operation and manner of using the above described pop-up swimming pool cleaner are believed to be obvious from the illustrations of the drawings and description of the parts set forth above, they are briefly outlined as follows.

Figure 5:
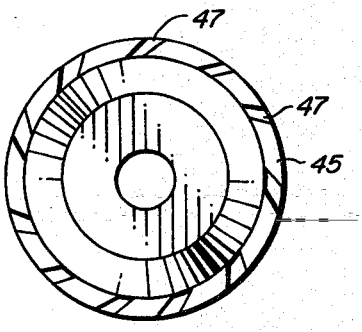
FIG. 5 is a plan view of a turbine casing.
Figure 8:
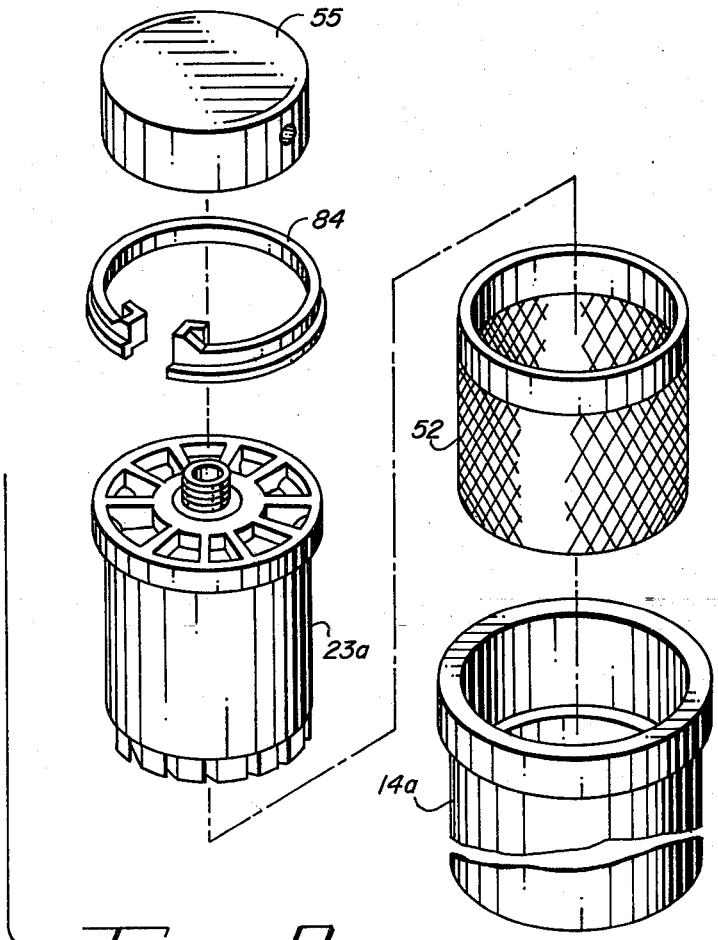
FIG. 8 is a perspective illustrating the elements of the cleaner of FIG. 10 in exploded relation.

With respect to the embodiment of FIG. 3, for example, water under pressure from conduit 19 passes through screen 52 and enters tangential inlets 47 which are best illustrated in FIG. 5 from which they impinge under pressure onto impeller blades 49 of impeller 48 to rotate the impeller and gear 51. Gear 51, which is a part of gear train 64, rotates gear 41 at a low angular velocity as compared to the speed of rotation of impeller 48. Gear 41 meshes with ring gear 33 to rotate rotor 29. Thus tube 36 is rotated as is jet block 55. Water from turbine casing 45 passes upwardly through openings 44 into duct 27. From the latter, some of the water engages the lower end of part 38 of tube 36 to force the latter upwardly until shoulder 39 engages shoulder 35. When this occurs, jet block 55 will be elevated or projected to the broken line position of FIG. 3.

A portion of the water in duct 27 passes through orifices 28 and about the various gears of gear train 64 for lubricating purposes.

Figure 13:
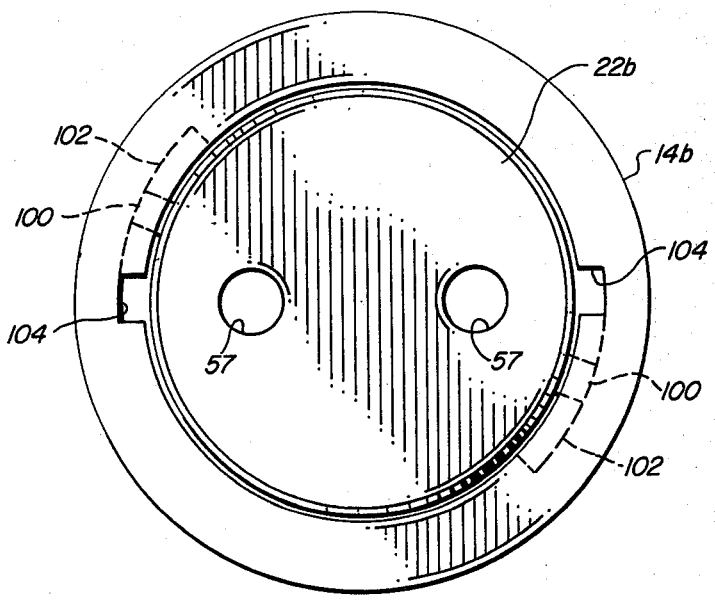
FIG. 13 is a plan view of the embodiment of FIG. 12.

With respect to the embodiments of FIG. 10 and FIG. 13, water under pressure from a water pump, for example, is present in conduit 19*a*. From conduit 19*a*, water passes through screen 52 and enters tangential inlets 47 of turbine casing 45. This water impinges on the blades 49 of impeller 48 to cause it to rotate. Rotation of impeller 48 causes shaft 50 to rotate and gear 51 which is mounted on shaft 50. Gear 51, which is a part of gear train 64*a*, through gear train 64*a* will cause shaft 42 to rotate. Rotation of shaft 42 which is at the other end of reduction gear train 64*a* will cause gear 41 to rotate at a very low angular velocity compared to that of impeller 48. Gear 41 meshes with teeth 32 of ring gear 33 to cause rotor 29 to rotate about its axis of rotation 66*a*. Water from turbine casing 45 passes upwardly through openings 44*a* in bottom wall 25*a* and through openings 106 in duct 27*a* into duct 27*a*. From duct 27*a* pressure of the water will force tube 36 upwardly until shoulder 35 engages shoulder 39. When this occurs, jet block 55 will be elevated about the surface 74 of pool 70 so that a jet of water will be directed from opening 61 in a plane substantially parallel to surface 74 of pool 70 to clean same. The jet of water from opening 61 will rotate in a plane perpendicular to the axis of rotation 66*a* of rotor 29.

Threaded plug 92 permits servicing gear train 64*a* to be readily accomplished when gear housing 23*a* or 23*b* is removed from its fitting 14*a* or 14*b*. Enclosing the reduction gear train 64*a* in an oil filled chamber eliminates water borne dirt from interfering with their operation. Adjusting the size and number of openings 44*a* permits one to optimize the amount of water flowing through impeller 48 and thus the speed of rotation of jet block 55 so that the optimum rpms for best cleaning at the depth of cleaner 9*a* in the pool can be achieved.

Just about all of the elements of the above described mechanism are of suitable plastic materials such as polyvinyl chloride (PVC), nylon, or the like which are particularly adapted to an environment such as water containing dissolved salts without any deleterious results.

While preferred embodiments of the subject pop-up swimming pool cleaner has been disclosed, it is to be clearly understood that the invention is not to be limited to the exact construction, mechanisms, and devices illustrated and described because various modifications of the these details may be provided in putting the invention into practice.

What is claimed is:

1. A pop-up cleaner for a swimming pool having wall means with circular openings therein, which openings are adapted to be connected to a source of water under pressure, said pool adapted to be filled with water, said water having an upper surface, comprising:

a gear housing having a disk constituting the upper end of the gear housing, a cylindrical wall, a bottom wall and an upper wall between the disk and the bottom wall, the space between the disk and the upper wall forming a ring gear chamber, said bottom wall having an opening to permit water to flow into the gear housing;

a rotor journaled through the disk for rotation about an axis of rotation and having an internally toothed ring gear positioned in the ring gear chamber;

a hollow tube having an upper end mounted in said rotor for a predetermined and limited linear movement parallel to the axis of rotation of the rotor, between a retracted position and a projected position, and for rotation with the rotor;

a jet block having a top surface, said jet block being removably secured to the upper end of said hollow tube, means forming a passage through the jet block and communicating with the hollow tube so that water can flow from the interior of the gear housing through the hollow tube and the passage through the jet block;

a turbine casing secured to the bottom wall of the gear housing including wall means having water inlets so that water under pressure can flow through said inlets into the turbine casing;

an impeller mounted for rotation within said casing on a shaft journaled for rotation through the bottom wall of the gear housing;

a reduction gear train mounted in the gear housing between the shaft journaled for rotation through the bottom wall of the gear housing and a shaft journaled through the upper wall of the gear housing;

gear means positioned in the ring gear chamber mounted on the shaft journaled through the upper wall of the gear housing to engage the teeth of the ring gear to rotate the ring gear, the rotor, and the hollow tube and the jet block; and cooperating threads on the housing and in a fitting located in an opening in the wall means below the surface of the water of a swimming pool, said jet block and gear housing being provided with cooperating projections and recesses with the projections adapted to be inserted into the recesses so that torque applied to the jet block can be transmitted to the gear housing for mounting and removing the gear housing in the fitting from a position above the surface, said fitting adapted to be connected to a conduit for water under pressure.

2. A pop-up cleaner for a swimming pool having wall means with circular openings therein, which openings are adapted to be connected to a source of water under pressure, said pool adapted to be filled with water, said water having an upper surface, comprising:

a gear housing having a disk constituting the upper end of the gear housing, a cylindrical wall, a bottom wall and an upper wall between the disk and the bottom wall, the space between the disk and the upper wall forming a ring gear chamber, said bottom wall having an opening to permit water to flow into the gear housing;

a rotor journaled through the disk for rotation about an axis of rotation and having an internally toothed ring gear positioned in the ring gear chamber;

a hollow tube having an upper end mounted in said rotor for a predetermined and limited linear movement parallel to the axis of rotation of the rotor, between a retracted position and a projected position, and for rotation with the rotor;

a jet block having a top surface, said jet block being removably secured to the upper end of said hollow tube, means forming a passage through the jet block and communicating with the hollow tube so that water can flow from the interior of the gear housing through the hollow tube and the passage through the jet block;

a turbine casing secured to the bottom wall of the gear housing including wall means having water inlets so that water under pressure can flow through said inlets into the turbine casing;

an impeller mounted for rotation within said casing on a shaft journaled for rotation through the bottom wall of the gear housing;

a reduction gear train mounted in the gear housing between the shaft journaled for rotation through the bottom wall of the gear housing and a shaft journaled through the upper wall of the gear housing;

gear means positioned in the ring gear chamber mounted on the shaft journaled through the upper wall of the gear housing to engage the teeth of the ring gear to rotate the ring gear, the rotor, and the hollow tube and the jet block; and cooperating projections and grooves on the housing and in a fitting located in an opening in the wall means below the surface of the water of a swimming pool, said jet block and gear housing being provided with cooperating projections and recesses with the projections adapted to be inserted into the recesses so that torque applied to the jet block can be transmitted to the gear housing for mounting and removing the gear housing in the fitting from a position above the surface, said fitting adapted to be connected to a conduit for water under pressure.

3. A pop-up cleaner for a swimming pool defined by walls, each of said walls having a surface, said pool adapted to have water in the pool, said water having a top surface, said cleaner comprising:

a housing having means for mounting said housing in a fitting;

a substantially cylindrical jet block having a top surface and an axis of symmetry, means for mounting said jet block on said housing for rotation about the jet block's axis of symmetry, for limited linear movement substantially parallel to the axis of symmetry, and for directing a stream of water over the surfaces of adjacent portions of the walls defining a swimming pool; and recesses formed in the top surface of the jet block adapted to cooperate with a tool for holding the jet block and for applying torque to the jet block, said jet block and housing being provided with cooperating projections and recesses said projections adapted to be inserted into the recesses whereby torque applied to the jet block can be applied to the housing for removably mounting the housing in the fitting, said fitting being located in a wall of said pool below the surface of the water in the pool from a position above the top surface of the water in said pool, said fitting adapted to be connected to a source of water under pressure.

4. The cleaner of claim 3 in which the means for mounting the cleaner in a fitting includes means for resiliently biasing the jet block away from the housing so that the recess and projection means are normally spaced apart so that the jet block is substantially free to turn relative to the housing.

5. The cleaner of claim 4 in which the means for resiliently biasing the jet block away from the housing includes a spring biased pin mounted on the housing.

* * * * *